US005128058A

United States Patent [19]

Ishii et al.

[11] Patent Number: 5,128,058

[45] Date of Patent: Jul. 7, 1992

[54] CONTACT LENS CLEANER CONTAINING A MICROCAPSULAR POLISHING AGENT

[75] Inventors: Fumiyoshi Ishii, Tokyo; Tomoko Kimura; Masahiro Hiranuma, both of Saitama, all of Japan

[73] Assignee: Hoya Corporation, Tokyo, Japan

[21] Appl. No.: 530,577

[22] Filed: May 30, 1990

[30] Foreign Application Priority Data

May 31, 1989 [JP] Japan ..... 1-138507

[51] Int. Cl.[5] ..... C11D 17/08

[52] U.S. Cl. ..... 252/174.13; 252/174.23; 252/174.25; 134/7; 428/407; 428/402.24

[58] Field of Search ..... 428/407, 402.24; 252/174.13, 174.23, 174.25; 51/295, 293, 296; 134/7

[56] References Cited

U.S. PATENT DOCUMENTS

| | | | |
|---|---|---|---|
| 4,132,533 | 1/1979 | Löhmer | 51/295 |
| 4,138,228 | 2/1979 | Hartfelt | 51/295 |
| 4,493,783 | 1/1985 | Su | 252/174.23 |
| 4,534,878 | 8/1985 | Ellis | 252/173 |
| 4,631,072 | 12/1986 | Koller | 51/309 |
| 4,655,957 | 4/1987 | Chromecek | 252/174.23 |
| 4,722,943 | 2/1988 | Melber | 521/57 |
| 4,908,391 | 3/1990 | Melber | 521/57 |
| 4,954,140 | 9/1990 | Kawashima | 51/295 |
| 5,017,238 | 5/1991 | Chromecek | 252/174.23 |
| 5,037,484 | 8/1991 | Su et al. | 252/174.23 |

FOREIGN PATENT DOCUMENTS 0159721 8/1985 Japan .

*Primary Examiner*—Prince Willis, Jr.
*Assistant Examiner*—Thomas Steinberg
*Attorney, Agent, or Firm*—Nixon & Vanderhye

[57] ABSTRACT

This invention relates to a contact lens cleaner comprising microcapsules and a desired liquid or semi-solid containing the microcapsules, the microcapsules each being formed by laminating a wall material comprised of an inorganic polishing agent on the surface of a core material having elasticity. The present contact lens cleaner can effectively remove dirt or stain on a contact lens surface without having any adverse effect on the contact lens, and can be very easily removed by washing it away with water after use.

15 Claims, No Drawings

CONTACT LENS CLEANER CONTAINING A MICROCAPSULAR POLISHING AGENT

BACKGROUND OF THE INVENTION

1. Field of the Invention

This invention relates to a contact lens cleaner which is used to clean a contact lens surface. In particular, it relates to a contact lens cleaner, which is used to remove dirt or stains sticking or firmly adhering to a contact lens surface by rubbing it against the lens surface.

2. Description of Prior Art

Conventional cleaners to remove dirt or stains sticking (firmly adhering) to a contact lens are described in Japanese Unexamined Patent Publications Nos. 192922/1982 and 6215/1981. Japanese Unexamined Patent Publication No. 192922/1982 proposes a cleaner containing a granular polymer such as an organic polymer (polyethylene, nylon 12, etc.), a polysiloxane polymer, or the like, and Japanese Unexamined Patent Publication No. 6215/1981 proposes a cleaner comprised of an inorganic substance per se such as alumina, or the like.

Since, however, the granular polymer contained in the cleaner disclosed in the above Japanese Unexamined Patent Publication No. 192922/1982 has very low polishing strength, such a cleaner is not satisfactory for the removal of dirt or stains sticking or firmly adhering to a lens surface.

On the other hand, the cleaner disclosed in Japanese Unexamined Patent Publication No. 6215/1981 contains an inorganic polishing agent (average particle diameter: 10 μm) comprised of an inorganic substance having high polishing strength. Such a cleaner therefore involves serious problems in that it scrapes the surface of a contact lens itself and, as a result, damages or deforms the lens. For this cleaner, the use of an inorganic polishing agent having a fine particle diameter might be taken into consideration in order to overcome the problem. However, the problem is that if the particle diameter is reduced (e.g. 0.1 μm as an average particle diameter), the inorganic polishing agent itself is liable to remain on a lens surface, and cannot be removed easily by washing.

SUMMARY OF THE INVENTION

It is an object of this invention to provide a contact lens cleaner having such advantages that (i) it has a remarkable cleaning power against dirt or stains on a contact lens surface, (ii) it does not cause damage, deformation, etc., on the contact lens itself, and (iii) it is very easily removable when washed with water, etc., after the contact lens is cleaned.

The present inventors have made a diligent study to achieve the above object, and consequently found the use of microcapsules each formed by laminating a wall material comprised of an inorganic polishing agent on the surface of an elastic core, whereby there is obtained a contact lens cleaner which can effectively remove dirt or stains from the contact lens surface without damaging the lens itself, and which is easily removable by washing it with water, etc. This invention has been completed on the basis of the above finding.

According to this invention, there is provided a contact lens cleaner, which comprises microcapsules and a desired liquid or semi-solid containing the microcapsules, the microcapsules each being formed by laminating a wall material comprised of an inorganic polishing agent on the surface of an elastic core.

DETAILED DESCRIPTION OF THE INVENTION

This invention is explained further in detail below.

The microcapsule, which is formed by laminating a wall material comprised of an inorganic polishing agent on the surface of an elastic core and constitutes this invention, is prepared according to a known technique using a reaction called a topochemical reaction or a mechanochemical reaction. That is, the microcapsule is prepared by utilizing the following phenomenon. When an elastic core material (e.g. plastic, etc.) to form a microcapsule core and an inorganic polishing agent to form a wall material laminated on the microcapsule core are mixed under agitation by using a ball mill, etc., friction occurs between the core material and the inorganic polishing agent. The core material consequently has an electric charge due to an electrification effect produced by the friction. As a result, a single particle or aggregate of the inorganic polishing agent adheres to the core surface. However, the microcapsule used in this invention shall not be limited to the microcapsule prepared by the above technique.

As a core material for the above microcapsule, a variety of plastic materials are usable. Any plastic materials are usable as far as they have elasticity, and a combined use of some of such plastic materials is also possible. Preferred examples of the core material are polyethylene, polystyrene, polytetrafluoroethylene, nylon (e.g. nylon 12), and the like, and those having an average particle diameter of 0.1 to 40 μm are suitable. However, the core material shall not be limited thereto.

Examples of the inorganic polishing agent used as the wall material of the microcapsule are silica, alumina, titanium dioxide, magnesium oxide, zirconium oxide, calcium carbonate, kaolin, and the like. However, the inorganic polishing agent is not particularly limited as far as it has a polishing power and is insoluble in water. It is preferable to use polishing particles having an average particle diameter of 0.1 to 9 μm, and in particular, alumina and titanium dioxide are preferably used. And, the average particle diameter of the wall material (inorganic polishing agent) is, preferably, smaller than that of the core material.

The microcapsules contained in the contact lens cleaner provided by this invention are prepared from the above core material and wall material. The core material and wall material are weighed out in a core material/wall material weight ratio of 9/1 to ⅛, and mixed with each other under agitation for 15 to 240 minutes by using a ball mill (50 to 250 rpm), whereby one embodiment of the microcapsules usable in the contact lens cleaner provided by this invention can be obtained. The conditions for the microcapsule preparation may be set depending upon desired physical property values of the contact lens cleaner. And, besides the ball mill, any apparatus may be used as far as the materials can be mixed under agitation as in the ball mill.

This invention provides a contact lens cleaner which comprises a desired liquid, e.g. a liquid consisting mainly of water, and the above microcapsules contained in the liquid. However, this invention does not exclude the mode in which the microcapsules are dispersed in the a desired liquid each time the cleaner is used.

Further, the contact lens cleaner of this invention may be applied not only to a cleaner in a suspended state but also to a cleaner in a semi-solid state such as ointment, etc.

The microcapsules contained in the contact lens cleaner provided by this invention have an average particle diameter of 0.3 to 50 μm. When this average particle diameter is less than 0.3 μm, the resultant cleaner has insufficient cleaning power. When it exceeds 50 μm, the cleaning efficiency of the cleaner is reduced, which reduction not only requires a long period of time for cleaning a lens by rubbing but also gives foreign feelings in washing a lens by rubbing.

The concentration of the microcapsules in the cleaner is 5 to 20 W/V %. When the concentration is less than 5 W/V %, the cleaner has insufficient cleaning power. And, even if it exceeds 20 W/V %, there is no further remarkable increase in effect. The more preferable concentration is 10 to 15 W/V %.

The cleaning effect of the cleaner of this invention may be increased by incorporating as a dispersant a crystalline cellulose (which is produced by hydrolyzing pulp with a mineral acid under certain conditions, washing it thereby to remove noncrystalline regions thereof, then milling the remainder, purifying it and drying it, and, for example, it is commercially available from Asahi Chemical Industry Co., Ltd., under the trade name of Avicel). The crystalline cellulose improves the suspension stability (dispersibility) of the contact lens cleaner of this invention when it is mixed with the other components of this invention under agitation. And, the crystalline cellulose which works as a dispersant has a soft-polishing function by itself, and this soft-polishing function further increases the cleaning power of the cleaner of this invention by working synergistically with the cleaning effect of the microcapsules. Further, the crystalline cellulose also works to ease the removal of the cleaner components when the cleaner is washed away with water, etc. Therefore, the crystalline cellulose is a component which makes the cleaner of this invention more effective as a contact lens cleaner. The crystalline cellulose produces the above effects when it is incorporated in an amount of 5 to 20 W/V %. When this amount is less than 5 W/V %, the crystalline cellulose neither exhibits its polishing function nor contributes to suspension stability. When the amount exceeds 20 W/V %, the fluidity of the resultant cleaner is reduced, and it is difficult to achieve the intended object of this invention, i.e. the cleaning of a contact lens by rubbing the cleaner against the contact lens. The more preferred amount thereof is 7 to 15 W/V %.

The contact lens cleaner of this invention may contain a surfactant. Although the surfactant is not critical, nonionic surfactants are suitably used. Polymer surfactants having a molecular weight of 1,000 to 20,000, e.g. polyoxyethylene-polyoxypropylene block copolymers are useful. The chemical cleaning power of these surfactants synergistically works with the cleaning effect of the microcapsules, whereby the cleaning power of the cleaner of this invention is improved. In particular, the cleaner of this invention containing the surfactant has a very high effect on a lens to which a large amount of greasy dirt or stain matter has adhered. The amount of the surfactant is suitably 0.5 to 5 W/V %. When this amount is less than 0.5 W/V %, the surfactant does not exhibit the above effect. And, even when it exceeds 5 W/V %, there is no further remarkable increase in the chemical cleaning power of the surfactant.

The contact lens cleaner of this invention may further contain a thickener, antiseptic, chelating agent, isotonicity-forming agent and buffer as required. Examples of the thickener are hydroxypropylmethyl cellulose, hydroxyethyl cellulose, methyl cellulose, sodium carboxymethylcellulose, etc. These thickeners can impart the cleaner of this invention with suitable viscosity and fluidity. Examples of the antiseptic are sorbic acid, chlorohexidine gluconate, benzalkonium chloride, methyl- or propylparaben, thimerosal, etc. These antiseptics can provide the cleaner with a long shelf life even if the cleaner is a multi-component one. The buffer not only has an effect to provide the cleaner with excellent pH stability, but also is useful for the production of a cleaner of which the pH is neutral and the osmotic pressure is isotonic with tear liquid, if used with an isotonicity-forming agent, whereby a cleaner which is usable also for a soft contact lens without any problem can be obtained.

Known buffers, isotonicity-forming agents and chelating agents are usable.

The contact lens cleaner of this invention can be used, e.g. in the following manner. That is, after a lens is taken off from the eye, one or two drops of the cleaner of this invention is dropped on the lens, and the lens is cleaned with the fingers by rubbing the cleaner against the lens for 20 to 30 seconds. After the cleaning, the lens is washed with water and stored in a prescribed manner or put on at once.

EXAMPLES

This invention will be explained specifically hereinbelow by reference to Examples.

EXAMPLE 1

Three grams of spherical polyethylene particles (average particle diameter: 10 μm) to form a core and 15.0 g of alumina particles (average particle diameter: 1 μm) as a wall material were mixed in a ball mill under agitation for 60 minutes to form microcapsules (average particle diameter: 15 μm). Purified water was added to 15 parts by weight of the microcapsules until the resulting amount became 100 parts by volume, and these components were mixed in a usual agitator under agitation for 20 minutes to give a cleaner.

When the cleaner in this Example is used, the cleaner is brought into a fully dispersed state before use by shaking a container containing the cleaner.

EXAMPLE 2

Purified water was added to a mixture of 15 parts by weight of the same microcapsules as those formed in Example 1 with 3 parts by weight of a nonionic surfactant (polyoxyethylene-polyoxypropylene block copolymer) until the resulting amount became 100 parts by volume. These components were treated in the same way as in Example 1 to give a cleaner.

The cleaner of this Example is also used in the same manner as in Example 1.

EXAMPLE 3

Purified water was added to 10 parts by weight of a crystalline cellulose (Avicel PH-M06, supplied by Asahi Chemical Industry Co., ltd.) until the resulting amount became about 50 parts by volume. The resultant mixture was agitated in a homogenizer (a homomixer is also usable) at 12,000 rpm for 15 minutes to obtain a smooth suspension. 10 Parts by weight of the same microcapsules as those formed in Example 1 and 3 parts by weight of a nonionic surfactant (polyoxyethylene-polyoxypropylene block copolymer) were added to the smooth suspension, and purified water was further added until the resulting amount became 100 parts by volume. These components were mixed under slow agitation in a usual agitator for 30 minutes to give a cleaner.

EXAMPLE 4

Purified water was added to a mixture of 8 parts by weight of a crystalline cellulose (Avicel TG-102L, supplied by Asahi Chemical Industry Co., Ltd.) with 0.4 part by weight of a crystalline cellulose (Avicel RC-591, supplied by Asahi Chemical Industry Co., Ltd.), and these components were treated in the same way as in Example 3 to obtain a suspension. 10 Parts by weight of the same microcapsules as those formed in Example 1 and 2 parts by weight of an anionic surfactant (triethanolaminelaurylsulfate) were added to the suspension, and these components were treated in the same way as in Example 3 to give a cleaner.

EXAMPLE 5

10 Parts by weight of the same microcapsules as those formed in Example 1, 3 parts by weight of a nonionic surfactant (polyoxyethylene-polyoxypropylene block copolymer), 0.1 part by weight of sorbic acid and 1.3 parts by weight of hydroxypropylmethyl cellulose were added to the same suspension as that obtained in Example 4, and these components were treated in the same way as in Example 3 to give a cleaner.

EXAMPLES 6-8

Example 5 was repeated except that the amount of the same microcapsules as those obtained in Example 1 was changed to 5 parts by weight, 15 parts by weight or 20 parts by weight, whereby cleaners for a contact lens were obtained.

EXAMPLES 9-10

Example 5 was repeated except that the amount of the nonionic surfactant (polyoxyethylene-polyoxypropylene block copolymer) was changed to 1 part by weight or 5 parts by weight, whereby cleaners for a contact lens were obtained.

EXAMPLES 11-12

Example 5 was repeated except that the amount of the crystalline cellulose (Avicel TG-102L, supplied by Asahi Chemical Industry Co., Ltd.) was changed to 6 parts by weight or 15 parts by weight, whereby cleaners for a contact lens were obtained.

EXAMPLES 13-15

Microcapsules (average particle diameter: 7 μm) were formed from 3.0 g of polyethylene particles (average particle diameter: 5 μm) and 12 g of titanium dioxide particles (average particle diameter: 0.3 μm). Then, Example 5 was repeated except that 5 parts, 10 parts or 15 parts by weight of these microcapsules were used in place of the microcapsules used in Example 5, whereby cleaners for a contact lens were obtained.

COMPARATIVE EXAMPLES 1-3

3 Parts by weight of a nonionic surfactant (polyoxyethylene-polyoxypropylene block copolymer), 0.1 part by weight of sorbic acid and 1.3 parts by weight of hydroxypropylmethyl cellulose were added to the same suspension as that obtained in Example 4. Then, polyethylene particles (average particle diameter: 40 μm), alumina particles (average particle diameter: 0.1 μm) or alumina particles (average particle diameter: 10 μm) were further added, and the resultant mixtures were treated in the same way as in Example 3 to give cleaners for Comparative Examples 1 to 3.

PERFORMANCE TEST

The cleaners obtained in the above Examples and Comparative Examples were subjected to performance tests (1) to (4) which will be described later. Table 1 shows the results.

TABLE 1

| | | Example | | | | | | | | | | | | | | | Comparative Example | | |
|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 1 | 2 | 3 |
| COMPONENTS (W/V %) | | | | | | | | | | | | | | | | | | | |
| Microcapsule | MAE | 15 | 15 | 10 | 10 | 10 | 5 | 15 | 20 | 10 | 10 | 10 | 10 | | | | | | |
| | MTE | | | | | | | | | | | | | 5 | 10 | 15 | | | |
| Crystalline | TG102L | | | | 8 | 8 | 8 | 8 | 8 | 8 | 8 | 6 | 15 | 8 | 8 | 8 | 8 | 8 | 8 |
| cellulose | RC-591 | | | | 0.4 | 0.4 | 0.4 | 0.4 | 0.4 | 0.4 | 0.4 | 0.4 | 0.4 | 0.4 | 0.4 | 0.4 | 0.4 | 0.4 | 0.4 |
| (Avicel) | PH-M06 | | | 10 | | | | | | | | | | | | | | | |
| Surfactant | OEOP | | 3 | 3 | | 3 | 3 | 3 | 3 | 1 | 5 | 3 | 3 | 3 | 3 | 3 | 3 | 3 | 3 |
| | TRS | | | | 2 | | | | | | | | | | | | | | |
| HPMC | | | | | | 1.3 | 1.3 | 1.3 | 1.3 | 1.3 | 1.3 | 1.3 | 1.3 | 1.3 | 1.3 | 1.3 | 1.3 | 1.3 | 1.3 |
| Sorbic acid | | | | | | 0.1 | 0.1 | 0.1 | 0.1 | 0.1 | 0.1 | 0.1 | 0.1 | 0.1 | 0.1 | 0.1 | 0.1 | 0.1 | 0.1 |
| Polyethylene particle | | | | | | | | | | | | | | | | | | | |
| (av. part. diam. 40 μm) | | | | | | | | | | | | | | | | | 15 | | |
| Alumina | | | | | | | | | | | | | | | | | | | |
| (av. part. diam. 0.1 μm) | | | | | | | | | | | | | | | | | | 3 | |
| (av. part. diam. 10 μm) | | | | | | | | | | | | | | | | | | | 3 |
| DIRT REMOVAL EFFECT | | | | | | | | | | | | | | | | | | | |
| Lens with | HOYA soft | A | A | A | A | A | C | A | A | A | A | A | A | C | B | A | E | B | A |
| artificial dirt | HOYA hard | A | A | A | A | A | C | A | A | A | A | A | A | C | B | A | E | B | A |
| | HOYA hard/58 | A | A | A | A | A | C | A | A | A | A | A | A | C | B | A | E | B | A |
| Lens with | HOYA soft | B | A | A | A | A | B | A | A | A | A | A | A | B | A | A | E | B | A |
| dirt after put | HOYA hard | B | A | A | A | A | B | A | A | A | A | A | A | B | A | A | E | B | A |
| on | HOYA hard/58 | B | A | A | A | A | B | A | A | A | A | A | A | B | A | A | E | B | A |
| INFLUENCE ON LENS | | | | | | | | | | | | | | | | | | | |
| Lens surface | HOYA soft | O | O | O | O | O | O | O | O | O | O | O | O | O | O | O | O | O | X |

TABLE 1-continued

| | | Example | | | | | | | | | | | | | | | Comparative Example | | |
|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 1 | 2 | 3 |
| state | HOYA hard | O | O | O | O | O | O | O | O | O | O | O | O | O | O | O | O | O | X |
| | HOYA hard/58 | O | O | O | O | O | O | O | O | O | O | O | O | O | O | O | O | O | X |
| Lens form | HOYA soft | O | O | O | O | O | O | O | O | O | O | O | O | O | O | O | O | O | X |
| | HOYA hard | O | O | O | O | O | O | O | O | O | O | O | O | O | O | O | O | O | X |
| | HOYA hard/58 | O | O | O | O | O | O | O | O | O | O | O | O | O | O | O | O | O | X |
| RESIDUAL CLEANER AFTER WASHING WITH WATER | | O | O | O | O | O | O | O | O | O | O | O | O | O | O | O | O | X | O |
| DISPERSION STABILITY | | | | O | O | O | O | O | O | O | O | O | O | O | O | O | O | O | O |

Abbreviations in Table 1 stand for the following:
MAE: Microcapsules formed of polyethylene particles and alumina particles.
MTE: Microcapsules formed of polyethylene particles and titanium dioxide particles.
OEOP: Polyoxyethylene/polyoxypropylene block copolymer.
TRS: Triethanolaminelaurylsulfate
HPMC: Hydroxypropylmethyl cellulose

(1) DIRT REMOVAL EFFECT

(1-a) Dirt Removal Effect On Artificial Dirt

Artificial dirt was allowed to adhere to soft contact lenses (HOYA soft, trade name, supplied by HOYA Corporation), hard contact lenses (HOYA hard, trade name, supplied by HOYA Corporation) and oxygen-permeable hard contact lenses (HOYA hard/58, trade name, supplied by HOYA Corporation) in the following manner.

A liquid of dirt was prepared by dissolving 1.0 g of lysozyme chloride and 1.0 g of albumin in an isotonic sodium chloride solution such that the total amount of the resultant liquid became 100 ml. The lenses were immersed in the liquid of dirt and heat-treated at 80° C. for 30 minutes. Then, the lenses were washed with water. This procedure was repeated five times to allow dirt to adhere to the lenses.

A few drops of each of the contact lens cleaners prepared in Examples and Comparative Examples was dropped on each of these contact lenses, and it was rubbed against the lenses with the fingers for about 20 seconds.

Then, the lenses were washed with water to remove the cleaners, and dirt removal states of the lenses were observed with a magnifying glass, and were evaluated according to the following six ratings based on degrees of cleaning effect.

A: Complete removal.
B: Nearly complete removal.
C: Rough removal.
D: Insufficient removal.
E: Almost no removal.
F: No removal.

As is clearly shown in Table 1, the cleaners obtained in Examples 1 to 15 and Comparative Examples 2 and 3 were effective to remove artificial dirt from the lenses.

(1-b) Dirt Removal Effect on Dirt on Lenses Actually Put on

The cleaners were tested in the same way as in (1-a) by using three types of contact lenses which were the same as those used in (1-a) and had dirt on the surface after actually put on.

As is clearly shown in Table 1, the cleaners obtained in Examples 1 to 15 and Comparative Examples 2 and 3 had an excellent effect on removal of dirt adhering to the surfaces of the lenses which had been actually put on.

(2) INFLUENCE ON CONTACT LENSES PER SE (CHANGES IN LENS SURFACE STATE AND LENS FORM)

A few drops each of the contact lens cleaners was dropped on each of three types of contact lenses which were new but the same as those used in the tests on the above (1) dirt removal effect. And, the cleaners were rubbed against the lenses for 20 seconds, and washed away with water. This procedure was repeated 1,000 times on each of the lenses.

The surface states of the resultant lenses were observed under a stereomicroscope magnifying 20 diameters, and further, the forms of the lenses were examined by measuring lens parameters [base curve (curvature), diameter and central thickness (thickness in the central portion)].

The lenses cleaned with the cleaner of Comparative Example 3 had damage on the surface, and suffered changes in the lens parameters as compared with their states before the cleaning.

In contrast, the cleaners of Examples 1 to 15 and Comparative Examples 1 and 2 had no influence on the lenses such as damage and haze as compared with the states of the lenses before the cleaning, and these cleaners did not cause any change in the lens parameters, either.

Therefore, the cleaner according to this invention has no influence on contact lenses per se.

(3) RESIDUAL CLEANER AFTER WASHING WITH WATER

A few drops of each of the contact lens cleaners was dropped on each of new soft contact lenses (HOYA soft) and rubbed against the lens for about 20 seconds. Then, the lenses were washed with water to remove the cleaners. The lenses were observed by using a magnifying glass to see whether there were any residual cleaners. In Table 1, the mark "O" stands for no residual cleaner, and the mark "X" for the presence of a residual cleaner.

The observation showed that the cleaners of Examples 1 to 15 and Comparative Examples 1 and 3 could be easily washed away with water after the cleaning by rubbing.

(4) DISPERSION STABILITY

The contact lens cleaners (about 15 ml each) were respectively charged into test tubes, and the test tubes were allowed to stand at room temperature for six months. The changes of suspension state with time were observed to evaluate the dispersion stability of these cleaners. In Table 1, the mark "O" stands for no change in suspension state. The cleaners of Examples 1 and 2 were not tested on the suspension stability, since they were intended to be shaken before use.

The cleaners of Examples 3 to 15 exhibited no change in suspension state such as separation or precipitation after the standing for six months, and maintained a stable suspension state.

EXAMPLES 16–18

Microcapsules (average particle diameter: 13 μm) were formed from 7.0 g of polyethylene particles (average particle diameter: 10 μm) and 3.0 g of alumina particles (average particle diameter: 1 μm). Then, Example 5 was repeated except that 5 parts, 10 parts or 15 parts by weight of these microcapsules were used in place of the microcapsules used in Example 5, whereby cleaners for a contact lens were obtained.

The contact lens cleaners of Examples 16–18 were subjected to performance tests (1) to (4) mentioned above. Table 2 shows the results. From Table 2, it is clearly shown that the contact lens cleaners of Examples 16–18 were effective to remove dirt from the lenses; have no influence on contact lenses per se; could be easily washed away with water; and exhibited no change in suspension state after the standing for a long period of time.

TABLE 2

| | | Example | | |
|---|---|---|---|---|
| | | 16 | 17 | 18 |
| COMPONENTS (W/V %) | | | | |
| Microcapsule | MAE | 5 | 10 | 15 |
| | MTE | | | |
| Crystalline | TG102L | 8 | 8 | 8 |
| cellulose | RC-591 | 0.4 | 0.4 | 0.4 |
| (Avicel) | PH-M06 | | | |
| Surfactant | OEOP | 3 | 3 | 3 |
| | TRS | | | |
| HPMC | | 1.3 | 1.3 | 1.3 |
| Sorbic acid | | 0.1 | 0.1 | 0.1 |
| Polyethylene particle | | | | |
| (av. part. diam. 40 μm) | | | | |
| Alumina | | | | |
| av. part. diam. 0.1 μm | | | | |
| av. part. diam. 10 μm | | | | |
| DIRT REMOVAL EFFECT | | | | |
| Lens with | HOYA soft | C | A | A |
| artificial dirt | HOYA hard | C | A | A |
| | HOYA hard/58 | C | A | A |
| Lens with dirt | HOYA soft | B | A | A |
| after put on | HOYA hard | B | A | A |
| | HOYA hard/58 | B | A | A |
| INFLUENCE ON LENS | | | | |
| Lens surface | HOYA soft | O | O | O |
| state | HOYA hard | O | O | O |
| | HOYA hard/58 | O | O | O |
| Lens form | HOYA soft | O | O | O |
| | HOYA hard | O | O | O |
| | HOYA hard/58 | O | O | O |
| RESIDUAL CLEANER AFTER WASHING WITH WATER | | O | O | O |
| DISPERSION STABILITY | | O | O | O |

Abbreviations in Table 2 are the same as those in Table 1.

As is clear in the above performance tests, the cleaner of Comparative Example 1, which contained polyethylene particles (organic polymer) to utilize their polishing power for the lens cleaning, had an insufficient effect on dirt removal. Concerning the cleaners containing an inorganic polishing agent, i.e. alumina, a dirt removal effect could be produced. However, the cleaner of Comparative Example 3 which contained alumina particles having a larger particle diameter (average particle diameter 10 μm) caused damage on the lens surface, and deformed the lens. In the cleaner of Comparative Example 2 which contained alumina particles having a smaller diameter (average particle diameter 0.1 μm) to prevent the above defect, it was difficult to remove the cleaner by washing it with water.

In contrast, the cleaners of Examples 1 to 18 contained microcapsules using as cores elastic polyethylene particles and, as walls, an inorganic polishing agent, alumina particles or titanium dioxide particles which had a small particle diameter but sufficient polishing power. For this reason these cleaners fully retained the polishing power of the inorganic polishing agent per-se and at the same time had no adverse effects such as damage, etc., on lenses due to the elasticity of the microcapsule.

Further, since the microcapsules had a suitable particle size for washing them away with water, these cleaners could be easily removed by washing them with water after the cleaners were used to clean lenses.

No cleaners of Comparative Examples can satisfy all of the following three points: Excellent dirt removal effect, little adverse effect on lenses and ease in cleaner removal by washing the cleaner away with water after use.

Therefore, the cleaners of the present Examples can satisfy the above three points and are therefore useful.

As detailed above, the contact lens cleaner of this invention makes it possible to effectively remove dirt or stain adhering to contact lens surfaces without having any adverse influence on the contact lenses. Further, the cleaner of this invention can be very easily removed by washing it away with water after use. Therefore, the contact lens cleaner of this invention is very useful.

What is claimed is:

1. A contact lens cleaning composition for removing dirt and stains from the surface of contact lenses, said composition consisting essentially of solid microcapsules dispersed in an aqueous liquid or ointment vehicle, the microcapsules having a wall material of an inorganic polishing agent laminated to the surface of an elastic core material selected from the group consisting of polyethylene, polystyrene, polytetrafluoroethylene and nylon.

2. A cleaner according to claim 1, wherein the core material has an average particle diameter of 0.1 to 40 μm.

3. A cleaner according to claim 1, wherein the inorganic polishing agent is at least one member selected from the group consisting of silica, alumina, titanium dioxide, magnesium oxide, zirconium oxide, calcium carbonate and kaolin.

4. A cleaner according to claim 1, wherein the inorganic polishing agent has an average particle diameter of 0.1 to 9 μm.

5. A cleaner according to claim 1, wherein the microcapsules have a core material/wall material weight ratio of 9/1 to 1/8.

6. A cleaner according to claim 1, wherein the microcapsules are a product produced from a topochemical reaction or a mechanochemical reaction.

7. A cleaner according to claim 1, wherein the microcapsules have an average particle diameter of 0.3 to 50 μm.

8. A cleaner according to claim 1, wherein the desired liquid vehicle is a liquid composed mainly of water.

9. A cleaner according to claim 1, which comprises 5 to 20 W/V % of the microcapsules.

10. A cleaner according to claim 1, which further comprises at least one member selected from the group consisting of a dispersant, surfactant, thickener, aseptic, chelating agent and isotonicity-forming agent.

11. A cleaner according to claim 10, wherein the dispersant is a crystalline cellulose present in an amount of 5 to 20 W/V %.

12. A cleaner according to claim 10, wherein the surfactant is a nonionic surfactant present in an amount of 0.5 to 5 W/V %.

13. A cleaner according to claim 1, wherein the elastic core is spherical.

14. A contact lens cleaning composition, for removing dirt and stains from the surface of contact lenses, consisting essentially of from 5 to 20 W/V % of microcapsules having an average particle diameter of 0.3 to 50 μm and composed of a spherical, elastic core material selected from the group consisting of polyethylene, polystyrene, polytetrafluoroethylene and nylon and a wall material of an inorganic polishing agent laminated to the surface of the core, wherein the weight ratio of core to wall is in the range of 9:1 to 1:8, said microcapsules dispersed in an aqueous liquid or ointment vehicle.

15. A cleaner according to claim 14, further containing from 5 to 20 W/V % of a crystalline cellulose dispersant and, optionally, 0.5 to 5 W/V % of a nonionic surfactant.

* * * * *